US009897950B2

(12) United States Patent
Yoshiura et al.

(10) Patent No.: US 9,897,950 B2
(45) Date of Patent: Feb. 20, 2018

(54) FIXING DEVICE AND IMAGE FORMING APPARATUS

(71) Applicants: Arinobu Yoshiura, Miyagi (JP); Hideo Nagafuji, Kanagawa (JP); Kohichi Utsunomiya, Kanagawa (JP); Yutaka Ikebuchi, Kanagawa (JP); Motoyoshi Yamano, Kanagawa (JP)

(72) Inventors: Arinobu Yoshiura, Miyagi (JP); Hideo Nagafuji, Kanagawa (JP); Kohichi Utsunomiya, Kanagawa (JP); Yutaka Ikebuchi, Kanagawa (JP); Motoyoshi Yamano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/295,574

(22) Filed: Oct. 17, 2016

(65) Prior Publication Data

US 2017/0115610 A1 Apr. 27, 2017

(30) Foreign Application Priority Data

Oct. 23, 2015 (JP) ..... 2015-208824

(51) Int. Cl.
*G03G 15/20* (2006.01)

(52) U.S. Cl.
CPC ..... *G03G 15/2025* (2013.01); *G03G 15/2075* (2013.01)

(58) Field of Classification Search
CPC ..... G03G 15/2025; G03G 15/2075
See application file for complete search history.

(56) References Cited

U.S. PATENT DOCUMENTS

2006/0269334 A1* 11/2006 Takahashi ..... G03G 15/2064 399/329
2007/0280755 A1* 12/2007 Matsumoto ..... G03G 15/206 399/329
2007/0292175 A1 12/2007 Shinshi
2008/0187372 A1* 8/2008 Kato ..... G03G 15/6591 399/328
2010/0150623 A1* 6/2010 Matsumoto ..... G03G 15/2053 399/329

(Continued)

FOREIGN PATENT DOCUMENTS

JP 4-044083 2/1992
JP 2004-286922 10/2004

(Continued)

*Primary Examiner* — Carla Therrien
(74) *Attorney, Agent, or Firm* — Oblon, McClelland, Maier & Neustadt, L.L.P.

(57) ABSTRACT

A fixing device includes a fixing rotator rotatable in a predetermined direction of rotation and a heater that heats the fixing rotator. A nip formation pad is disposed opposite an inner circumferential surface of the fixing rotator. A pressure rotator presses against the nip formation pad via the fixing rotator to form a fixing nip between the fixing rotator and the pressure rotator. A low-friction member is sandwiched between the nip formation pad and the fixing rotator and bears a lubricant that flows in a flow direction. A thermal absorber is mounted on the inner circumferential surface of the fixing rotator. At least one irregular portion, mounted on the thermal absorber, blocks the lubricant flowing in the flow direction.

19 Claims, 7 Drawing Sheets

(56) References Cited

U.S. PATENT DOCUMENTS

| | | | | |
|---|---|---|---|---|
| 2010/0226698 | A1* | 9/2010 | Maruyama | B21D 22/16 399/313 |
| 2011/0052245 | A1 | 3/2011 | Shinshi et al. | |
| 2011/0058865 | A1 | 3/2011 | Tokuda et al. | |
| 2011/0058866 | A1 | 3/2011 | Ishii et al. | |
| 2011/0076071 | A1 | 3/2011 | Yamaguchi et al. | |
| 2012/0114345 | A1 | 5/2012 | Fujimoto et al. | |
| 2012/0121304 | A1 | 5/2012 | Tokuda et al. | |
| 2012/0155936 | A1 | 6/2012 | Yamaguchi et al. | |
| 2013/0170877 | A1 | 7/2013 | Yoshiura et al. | |
| 2013/0170879 | A1 | 7/2013 | Yoshinaga et al. | |
| 2013/0170880 | A1 | 7/2013 | Gotoh et al. | |
| 2013/0177340 | A1 | 7/2013 | Kawata et al. | |
| 2013/0183070 | A1 | 7/2013 | Kawata et al. | |
| 2013/0189008 | A1 | 7/2013 | Ishii et al. | |
| 2013/0195523 | A1 | 8/2013 | Yamaji et al. | |
| 2013/0195524 | A1 | 8/2013 | Ishii et al. | |
| 2013/0266355 | A1 | 10/2013 | Yoshiura et al. | |
| 2014/0086652 | A1* | 3/2014 | Sugiyama | G03G 15/2057 399/333 |
| 2014/0241766 | A1 | 8/2014 | Ishii et al. | |
| 2014/0286684 | A1 | 9/2014 | Takagi et al. | |
| 2015/0023705 | A1 | 1/2015 | Kawata et al. | |
| 2015/0261155 | A1 | 9/2015 | Yoshiura et al. | |
| 2015/0261157 | A1 | 9/2015 | Yamano et al. | |
| 2016/0011548 | A1 | 1/2016 | Utsunomiya et al. | |
| 2016/0011550 | A1 | 1/2016 | Utsunomiya et al. | |
| 2016/0223964 | A1 | 8/2016 | Ikebuchi et al. | |
| 2016/0274515 | A1 | 9/2016 | Imada et al. | |
| 2017/0102646 | A1* | 4/2017 | Ikebuchi | G03G 15/2025 |

FOREIGN PATENT DOCUMENTS

| | | |
|---|---|---|
| JP | 2005-003781 | 1/2005 |
| JP | 2005-173441 | 6/2005 |
| JP | 2005-274888 | 10/2005 |
| JP | 2006-091162 | 4/2006 |
| JP | 2006-267408 | 10/2006 |
| JP | 2007-147865 | 6/2007 |
| JP | 2007-334205 | 12/2007 |
| JP | 2010-139935 | 6/2010 |
| JP | 2010-140061 | 6/2010 |
| JP | 2010-204587 | 9/2010 |

* cited by examiner

FIXING DEVICE AND IMAGE FORMING APPARATUS

CROSS-REFERENCE TO RELATED APPLICATION

This patent application is based on and claims priority pursuant to 35 U.S.C. § 119 to Japanese Patent Application No. 2015-208824, filed on Oct. 23, 2015, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing, a toner image on a recording medium and an image forming apparatus incorporating the fixing device.

Description of the Background

Related-art image terming apparatuses, such as copiers, facsimile machines, printers, or multifunction printers having two or more of copying, printing, scanning, facsimile, plotter, and other functions, typically form an image on as recording medium according to image data. Thus, for example, a charger uniformly charges a surface of a photoconductor; an optical writer emits a light beam onto the charged surface of the photoconductor to form an electrostatic latent image on the photoconductor according to the image data a developing device supplies toner to the electrostatic latent image formed on the photoconductor to render the electrostatic latent image visible as a toner image; the toner image is directly transferred from the photoconductor onto a recording medium or is indirectly transferred front the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium hearing a toner image is conveyed. As the recording medium hearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing rotator rotatable in a predetermined direction of rotation and a heater that heats the fixing rotator. A nip formation pad is disposed opposite an inner circumferential surface of the fixing rotator. A pressure rotator presses against the nip formation pad via the fixing rotator to form a fixing nip between the fixing rotator and the pressure rotator. A low-friction member is sandwiched between the nip formation pad and the fixing rotator and bears a lubricant that flows in a flow direction. A thermal absorber is mounted on the inner circumferential surface of the fixing rotator. At least one irregular portion, mounted on the thermal absorber, blocks the lubricant flowing in the flow direction.

This specification further describes an improved image forming apparatus. In one exemplary embodiment, the image forming apparatus includes an image bearer to bear a toner image and a fixing device disposed downstream from the image bearer in a recording medium conveyance direction to fix the toner image on a recording medium. The fixing device includes a fixing rotator rotatable in a predetermined direction of rotation and a heater that beats the fixing rotator. A nip formation pad is disposed opposite an inner circumferential surface of the fixing rotator. A pressure rotator presses against the nip formation pad via the fixing rotator to form a fixing nip between the fixing rotator and the pressure rotator. A low-friction member is sandwiched between the nip formation pad and the fixing rotator and bears a lubricant that flows in as flow direction. A thermal absorber is mounted on the inner circumferential surface of the fixing rotator. At least one irregular portion, mounted on the thermal absorber, blocks the lubricant flowing in the flow direction.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
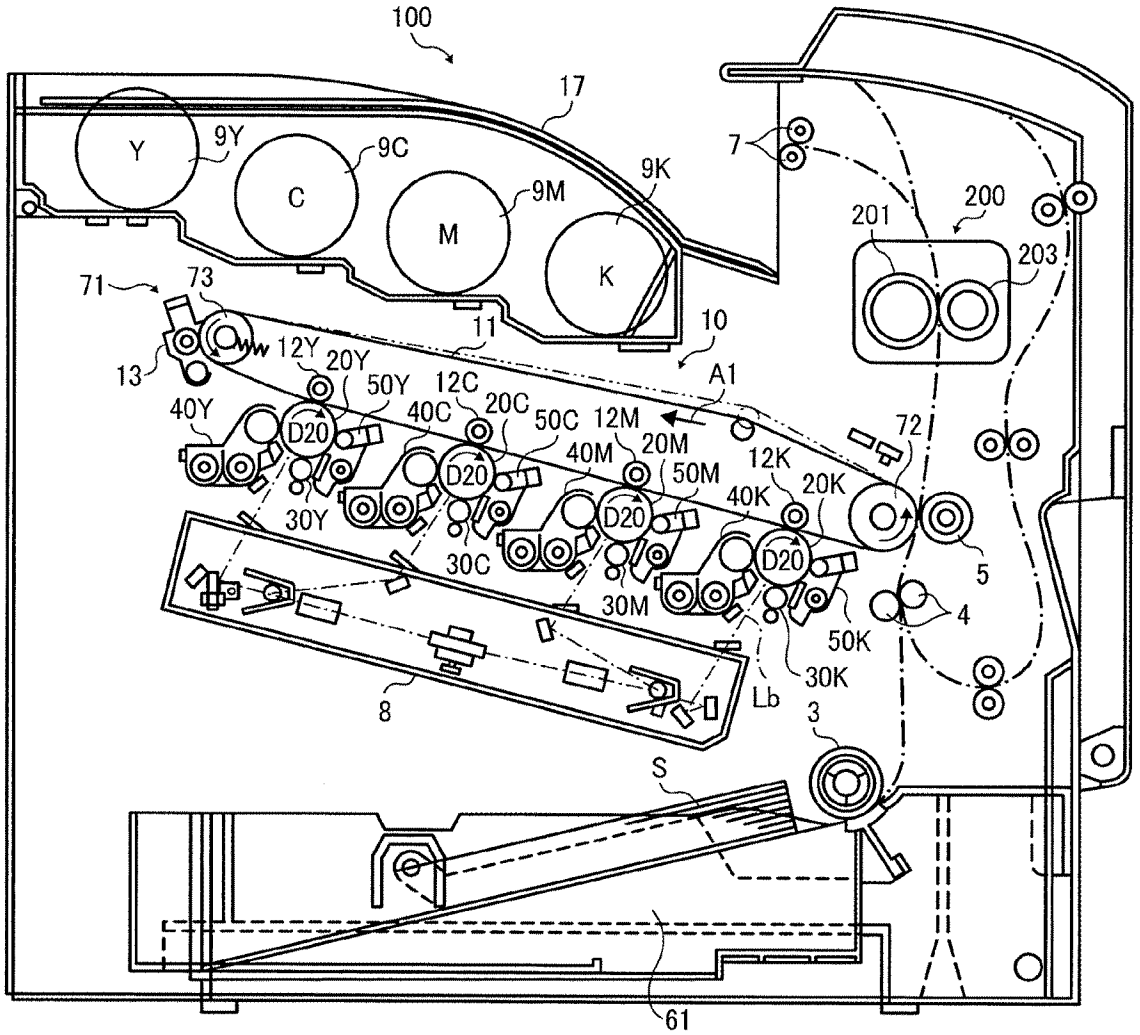
FIG. 1 is a schematic vertical cross-sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 100 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical cross-sectional view of the image forming apparatus 100. The image forming apparatus 100 may be a copier, a facsimile machine, as printer, a multifunction peripheral or a multifunction printer (MFP) having at least one of copying, printing, scanning, facsimile, and plotter functions, or the like. According to this exemplary embodiment, the image forming apparatus 100 is a color printer that forms color and monochrome toner images on a recording medium by electrophotography. Alternatively, the image forming apparatus 100 may be a monochrome printer that forms a monochrome toner image on a recording medium.

Referring to FIG. 1, a description is provided of a construction of the image forming apparatus 100.

The image forming apparatus 100 is a color printer employing a tandem system in which a plurality of image forming devices for forming toner images in a plurality of colors, respectively, is aligned in a stretch direction of a transfer belt. Alternatively, the image forming apparatus 100 may be a copier, a facsimile machine, a printer, an MFP, or the like.

The image forming apparatus 100 employs a tandem structure in which four photoconductive drums 20Y, 20C, 20M, and 20K serving as image bearers that bear yellow, cyan, magenta, and black toner images in separation colors, respectively, are aligned.

The yellow, cyan, magenta, and black toner images formed on the photoconductive drums 20Y, 20C, 20M, and 20K, respectively, are primarily transferred successively onto an endless transfer belt 11 serving as an intermediate transferor disposed opposite the photoconductive drums 20Y 20C, 20M, and 20K as the transfer belt 11 rotates in a rotation direction A1 such that the yellow, cyan, magenta, and black toner images are superimposed on a same position on the transfer belt 11 in a primary transfer process. Thereafter, the yellow, cyan, magenta, and black toner images superimposed on the transfer belt 11 are secondarily transferred onto a recording medium S (e.g., a recording sheet and a transfer sheet) collectively in a secondary transfer process.

Each of the photoconductive drums 20Y, 20C, 20M, and 20K is surrounded by image forming components that form the yellow, cyan, magenta, and black toner images on the photoconductive drums 20Y 20C, 20M, and 20K as the photoconductive drums 20Y, 20C, 20M, and 20K rotate clockwise in FIG. 1 in a rotation direction D20.

Taking the photoconductive drum 20K that forms the black toner image, the following describes an image forming operation to form the black toner image. The photoconductive drum 20K is surrounded by a charger 30K, a developing device 40K, a primary transfer roller 12K, and a cleaner 50K in this order in the rotation direction D20 of the photoconductive drum 20K. The photoconductive drums 20Y, 20C, and 20M are also surrounded by chargers 30Y, 30C, and 30M, developing devices 40Y, 40C, and 40M, primary transfer rollers 12Y, 12C, and 12M, and cleaners 50Y, 50C, and 50M in this order in the rotation direction D20 of the photoconductive drums 20Y, 20C, and 20M, respectively. After the charger 30K charges the photoconductive drum 20K, an optical writing device writes an electrostatic latent image on the photoconductive drum 20K.

As the transfer belt 11 rotates in the rotation direction A1, the yellow, cyan, magenta, and black toner images termed on the photoconductive drums 20Y, 20C, 20M, and 20K, respectively, are primarily transferred successively onto the transfer belt 11, thus being superimposed on the same position on the transfer belt 11. For example, the primary transfer rollers 12Y, 12C, 12M, and 12K disposed opposite the photoconductive drams 20Y, 20C, 20M, and 20K via the transfer belt 11, respectively, and applied with an electric voltage primarily transfer the yellow, cyan, magenta, and black toner images formed on the photoconductive drums 20Y, 20C, 20M, and 20K at different times from the upstream photoconductive drum 20Y to the downstream photoconductive drum 20K in the rotation direction A1 of the transfer belt 11.

The photoconductive drums 20Y, 20C, 20M, and 20K are aligned in this order in the rotation direction A1 of the transfer belt 11. The photoconductive drums 20Y, 20C, 20M and 20K are located in four image forming stations that balm the yellow, cyan, magenta, and black toner images, respectively.

The image forming apparatus 100 includes the four image forming stations, as transfer belt unit 10, a secondary transfer roller 5, a belt cleaner 13, and the optical writing device 8. The transfer belt unit 10 is situated above and disposed opposite the photoconductive drums 20Y, 20C, 20M, and 20K. The transfer belt unit 10 incorporates the transfer belt 11 and the primary transfer rollers 12Y, 12C, 12M, and 12K. The secondary transfer roller 5 serves as a transferor disposed opposite the transfer belt 11 and driven and rotated in accordance with rotation of the transfer belt 11. The belt cleaner 13 is disposed opposite the transfer belt 11 to clean the transfer belt 11. The optical writing device 8 is situated below and disposed opposite the four image forming stations.

The optical writing device 8 includes a semiconductor laser serving as at light source, a coupling lens, an fθ lens, a troidal lens, a deflection mirror, and a rotatable polygon mirror serving as a deflector. The optical writing device 8 emits light beams Lb corresponding to the yellow, cyan, magenta, and black toner images to be formed on the photoconductive drums 20Y, 20C, 20M, and 20K thereto, forming electrostatic latent images on the photoconductive drums 20Y, 20C, 20M, and 20K, respectively. FIG. 1 illustrates the light beam Lb irradiating the photoconductive drum 20K. Similarly, light beams irradiate the photoconductive drums 20Y, 20C, and 20M, respectively.

The image forming apparatus 100 further includes a sheet feeder 61 and a registration roller pair 4. The sheet feeder 61 incorporates a paper tray that loads a plurality of recording media S to be conveyed one by one to a secondary transfer nip formed between the transfer belt 11 and the secondary transfer roller 5. The registration roller pair 4 feeds a recording medium S conveyed from the sheet feeder 61 to the secondary transfer nip formed between the transfer belt 11 and the secondary transfer roller 5 at a predetermined time when the yellow, cyan, magenta, and black toner images superimposed on the transfer belt 11 reach the secondary transfer nip. The image forming apparatus 100 further includes a sensor for detecting that a leading edge of the recording medium S reaches the registration roller pair 4.

The image forming apparatus 100 further includes a fixing device 200, an output roller pair 7, an output tray 17, and toner bottles 9Y, 9C, 9M, and 9K. The fixing device 200 fixes a color toner image formed by the yellow, cyan, magenta, and black toner images secondarily transferred from the transfer belt 11 onto the recording medium S thereon. The output roller pair 7 ejects the recording medium S bearing the fixed toner image onto an outside of the image forming apparatus 100, that is, the output tray 17. The output tray 17 is disposed atop the image forming apparatus 100 and stacks the recording medium S elected by the output roller pair 7. The toner bottles 9Y 9C, 9M, and 9K are situated below the output tray 17 and replenished with fresh yellow, cyan, magenta, and black toners, respectively.

The transfer belt unit 10 includes a driving roller 72 and a driven roller 73 over which the transfer belt 11 is looped, in addition to the transfer belt 11 and the primary transfer rollers 12Y, 12C, 12M, and 12K.

Since the driven roller 73 also serves as a tension applicator that applies tension to the transfer belt 11, a biasing member (e.g., a spring) biases the driven roller 73 against the transfer belt 11. The transfer belt unit 10, the primary transfer rollers 12Y, 12C, 12M, and 12K, the secondary transfer roller 5, and the belt cleaner 13 construct a transfer device 71.

The sheet feeder 61 is situated in a lower portion of the image forming apparatus 100 and includes a feed roller 3 that contacts an upper side of an uppermost recording medium S of the plurality of recording media S loaded on the paper tray of the sheet feeder 61. As the feed roller 3 is driven and rotated counterclockwise in FIG. 1, the feed roller 3 feeds the uppermost recording medium S to the registration roller pair 4.

The belt cleaner 13 of the transfer device 71 includes a cleaning brush and a cleaning blade being disposed opposite and contacting the transfer belt 11. The cleaning brush and the cleaning blade scrape a foreign substance such as residual toner particles off the transfer belt 11, removing the foreign substance from the transfer belt 11 and thereby cleaning, the transfer belt 11. The belt cleaner 13 further includes a waste toner conveyer that conveys the residual toner particles removed from the transfer belt 11.

Figure 2:
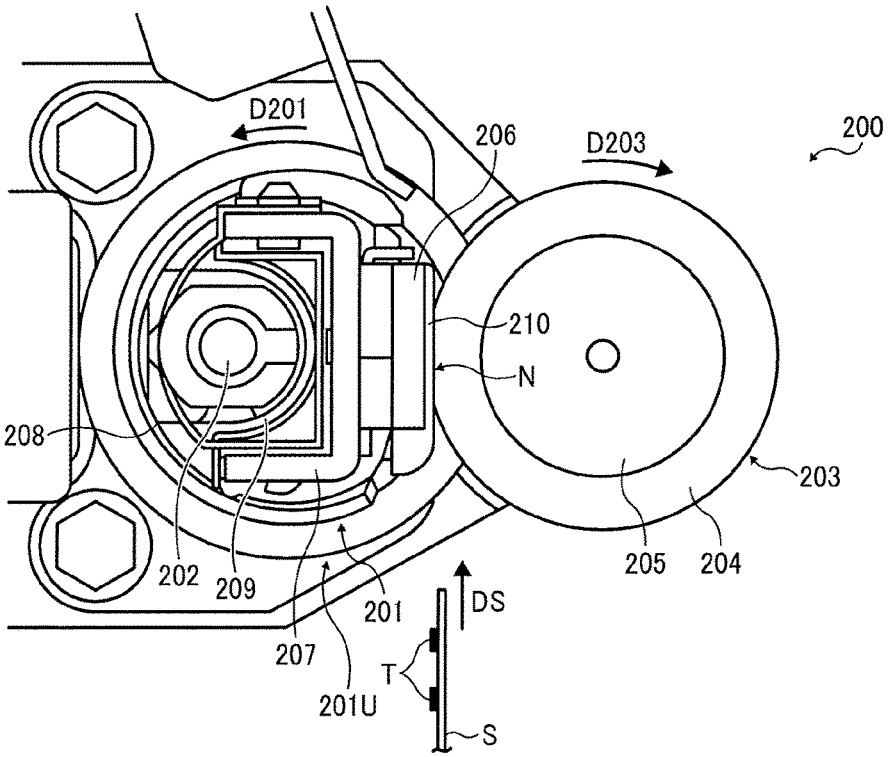
FIG. 2 is a vertical cross-sectional view of a fixing device according to a first exemplary embodiment of the present disclosure that is incorporated in the image forming apparatus depicted in FIG. 1.

Referring to FIG. 2, a description is provided of a construction of the fixing device 200 incorporated in the image forming apparatus 100 having the construction described above.

FIG. 2 is a vertical cross-sectional view of the fixing device 200 according to a first exemplary embodiment. As illustrated in FIG. 2, the fixing device 200 (e.g., a fuser or a fusing unit) includes a fixing belt 201 formed into a loop and serving as a fixing rotator or a fixing member rotatable in a rotation direction D201 and a pressure roller 203 serving as a pressure rotator disposed opposite the fixing belt 201 and rotatable in a rotation direction D203. A halogen beater 202 serving as a heater or a heat source is disposed inside the loop formed by the fixing belt 201. The halogen heater 202 emits heat or light that irradiates an inner circumferential surface of the fixing belt 201 directly, heating the fixing belt 201 with radiant heat or light. A nip formation pad 206 disposed opposite the pressure roller 203 via the fixing belt 201 presses against the pressure roller 203 via the fixing belt 201 to form a fixing nip N between the fixing belt 201 and the pressure roller 203. A low-friction sheet 210 serving as a low-friction member is sandwiched between the fixing belt 201 and the nip formation pad 206. As the fixing belt 201 rotates in the rotation direction D201, the inner circumferential surface of the fixing belt 201 slides over the nip formation pad 206 indirectly via the low-friction sheet 210.

The fixing device 200 further includes a support 207, a holder 208, and a reflector 209. The fixing belt 201 and the components disposed inside the loop formed by the fixing belt 201, that is, the halogen heater 202, the nip formation pad 206, the support 207, the holder 208, the reflector 209, and the low-friction sheet 210, may construct a belt unit 201U separably coupled to the pressure roller 203. As a recording medium S bearing an unfixed toner image T is conveyed through the fixing nip N, the fixing belt 201 and the pressure roller 203 melt and fix the toner image T on the recording medium S under heat and pressure.

As illustrated in FIG. 2, the fixing nip N is planar. Alternatively, the fixing nip N may be contoured into a recess, a curve, or other shapes, if the fixing nip N is recessed with respect to the pressure roller 203, the recessed fixing nip N directs the leading edge of the recording medium S toward the pressure roller 203 as the recording medium S is discharged from the fixing nip N, facilitating separation of the recording medium S from the fixing belt 201 and suppressing jamming of the recording medium S.

A detailed description is now given of a construction of the fixing belt 201.

The fixing belt 201 is an endless belt or endless film made of metal such as nickel and SUS stainless steel or resin such as polyimide. The fixing belt 201 is constructed of a base layer and a release layer. The release layer serving as an outer surface layer is made of tetrafluoroethylene-perfluoroalkylvinylether copolymer (PFA), polytetrafluoroethylene (PTFE), or the like to facilitate separation of toner of the toner image T on the recording medium S from the fixing belt 201 and prevent the toner from adhering to the fixing belt 201. An elastic layer may be sandwiched between the base layer and the release layer and made of silicone rubber or the like. If the fixing belt 201 does not incorporate the elastic layer, the fixing belt 201 has a decreased thermal capacity that improves fixing property of being heated quickly to a desired fixing temperature at which the toner image T is fixed on the recording medium S. However, as the pressure roller 203 and the fixing belt 201 sandwich and press the unfixed toner image T on the recording medium S passing through the fixing hip N, slight surface asperities of the fixing belt 201 may be transferred onto the toner image T on the recording medium S, resulting in variation in gloss of the solid toner image T that may appear as an orange peel image on the recording medium S. To address this circumstance, the elastic layer made of silicone rubber has a thickness not smaller than 100 micrometers. As the elastic layer deforms, the elastic layer absorbs slight surface asperities of the fixing belt 201, preventing formation of the faulty orange peel image.

A detailed description is now given of a configuration of the support 207, the holder 208, and the reflector 209.

The support 207 (e.g., a stay) supports the nip formation pad 206 and is situated inside the loop formed by the fixing belt 201. As the nip formation pad 206 receives pressure from the pressure roller 203, the support 207 supports the nip formation pad 206 to prevent bending of the nip formation pad 206 and produce a predetermined nip length in a recording medium conveyance direction DS throughout the entire width of the fixing belt 201 in an axial direction thereof parallel to a longitudinal direction of the nip formation pad 206. The support 207 is mounted on and secured to the holder 208 (e.g., a flange) at each lateral end of the support 207 in a longitudinal direction thereof parallel to the axial direction of the fixing belt 201, respectively, thus being positioned inside the fixing device 200. The reflector 209 interposed between the halogen heater 202 and the support 207 reflects radiant light or heat radiated from the halogen heater 202 to the reflector 209 toward the fixing belt 201, preventing the support 207 from being heated by the halogen heater 202 with radiant heat or the like and thereby reducing waste of energy.

Alternatively, instead of the reflector 209, an opposed face of the support 207 disposed opposite the halogen heater 202 may be treated with insulation or mirror finish to reflect light radiated from the halogen heater 202 to the support 207 toward the fixing belt 201. The halogen heater 202 serves as a heater for heating the fixing belt 201. Alternatively, the heater for heating the fixing belt 201 may be an induction heater (IH), a resistive heat generator, a carbon heater, or the like.

A detailed description is now given of a construction of the pressure roller 203.

The pressure roller 203 is constructed of a cored bar 205, an elastic rubber layer 204 coating the cored bar 205, and a surface release layer coating the elastic rubber layer 204 and being made of PFA or PTFE to facilitate separation of the recording medium S from the pressure roller 203. As a driving force generated by a driver (e.g., a motor) situated inside the image forming apparatus 100 depicted in FIG. 1 is transmitted to the pressure roller 203 through a gear train, the pressure roller 203 rotates in the rotation direction D203. A spring or the like presses the pressure roller 203 against the nip formation pad 206 via the fixing belt 201. As the spring presses and deforms the elastic rubber layer 204 of the pressure roller 203, the pressure roller 203 produces the fixing nip N having the predetermined nip length in the recording medium conveyance direction DS.

Alternatively, the pressure roller 203 may be a hollow roller that accommodates a heater such as a halogen beater. The elastic rubber layer 204 may be made of solid rubber. Alternatively, if no heater is situated inside the pressure roller 203, the elastic rubber layer 204 may be made of sponge rubber. The sponge rubber is more preferable than the solid rubber because the sponge rubber has an increased insulation that draws less heat from the fixing belt 201.

As the pressure roller 203 rotates in the rotation direction D203, the fixing belt 201 rotates in the rotation direction D201 in accordance with rotation of the pressure roller 203 by friction therebetween. As the driver drives and rotates the pressure roller 203, a driving force of the driver is transmitted from the pressure roller 203 to the fixing belt 201 at the fixing nip N, than rotating the fixing belt 201 by friction between the pressure roller 203 and the fixing belt 201. At the fixing nip N, the fixing belt 201 rotates as the fixing belt 201 is sandwiched between the pressure roller 203 and the nip formation pad 206; at a circumferential span of the fixing belt 201 other than the fixing nip N, the fixing belt 201 rotates as the fixing belt 201 is guided by the holder 208 at each lateral end of the fixing belt 201 in the axial direction thereof. With the construction described above, the fixing device 200 attaining quick warm-up is manufactured at reduced costs.

Figure 3:
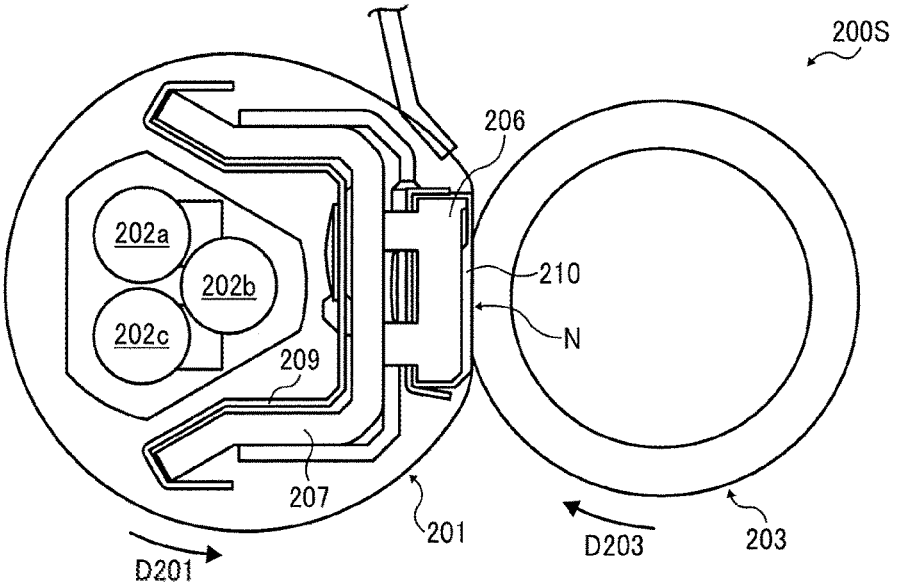
FIG. 3 is a vertical cross-sectional view of a fixing device according to a second exemplary embodiment of the present disclosure that is installable in the image forming apparatus depicted in FIG. 1.

Referring to FIG. 3, a description is provided of a construction of a fixing device 200S according to a second exemplary embodiment.

FIG. 3 is a vertical cross-sectional view of the fixing device 200S. Identical reference numerals are assigned to components identical or equivalent to the components incorporated in the fixing device 200 illustrated in FIG. 2.

The fixing device 200 according to the first exemplary embodiment depicted in FIG. 2 includes the single halogen heater 202. Conversely, the fixing device 200S according to the second exemplary embodiment depicted in FIG. 3 includes three halogen heaters 202*a*, 202*b*, and 202*c*. The halogen heaters 202*a*, 202*b*, and 202*c* have different heat generation spans in the axial direction of the fixing belt 201 that correspond to different widths of the recording media S, respectively, suppressing redundant heating and saving energy. Other components of the fixing device 200S according to the second exemplary embodiment are equivalent to the above-described components of the fixing device 200 according to the first exemplary embodiment depicted in FIG. 2.

Figure 4:
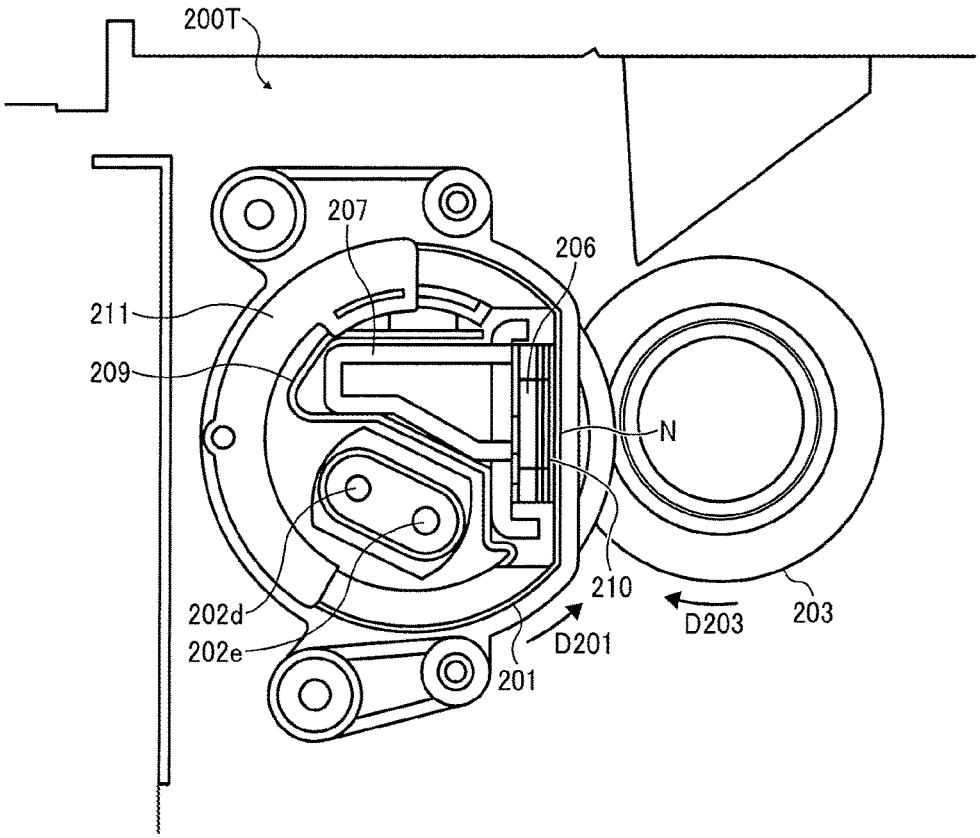
FIG. 4 is a vertical cross-sectional view of a fixing device according to a third exemplary embodiment of the present disclosure that is installable in the image forming apparatus depicted in FIG. 1.

Referring to FIG. 4, a description is provided of a construction of a fixing device 200T according to a third exemplary embodiment.

FIG. 4 is a vertical cross-sectional view of the fixing device 200T. Identical reference numerals are assigned to components identical or equivalent to the components incorporated in the fixing devices 200 and 200S depicted in FIGS. 2 and 3, respectively.

As illustrated in FIG. 4, the fixing device 200T includes two halogen heaters 202*d* and 202*e* instead of the three halogen heaters 202*a*, 202*b*, and 202*c* depicted in FIG. 3. In addition to the components of the fixing device 200S depicted in FIG. 3, the fixing device 200T depicted in FIG. 4 includes a light shield 211 interposed between the halogen heaters 202*d* and 202*e* and the fixing belt 201 to shield the fixing belt 201 from the halogen heaters 202*d* and 202*e*.

Figure 5:
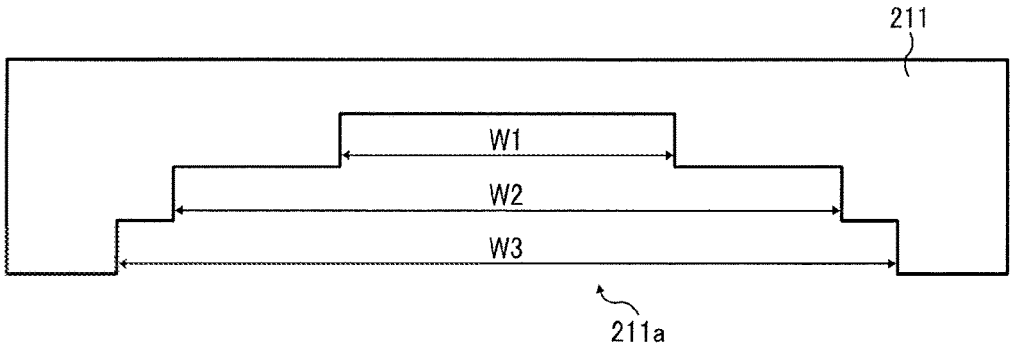
FIG. 5 is a plan view of a light shield incorporated in the fixing device depicted in FIG. 4.

FIG. 5 is a plan view of the light shield 211. As illustrated in FIG. 5, the light shield 211 includes an aperture 211*a* serving as a non-shield portion that does not shield the fixing belt 201 from the halogen heaters 202*d* and 202*e*. The aperture 211*a* has a plurality of widths in the axial direction of the fixing belt 201 that corresponds to a plurality of sizes of recording media S, that is, as width W1 corresponding to a width of a postcard, a width W2 corresponding to a width of a B4 size sheet, and a width W3 corresponding to a width of an A3 size sheet.

Figure 6A:
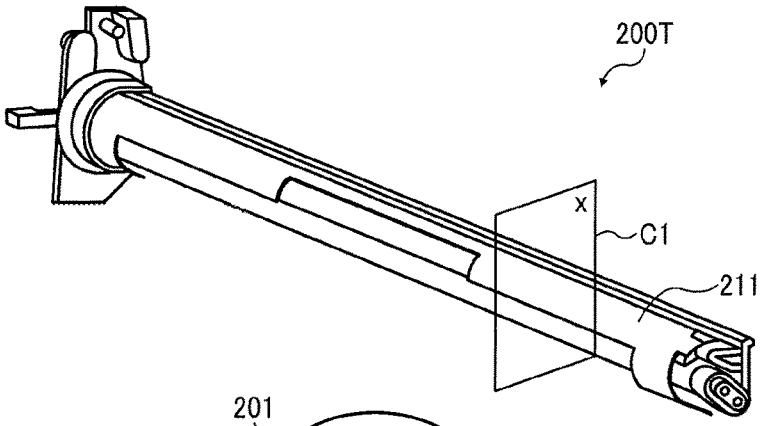
FIG. 6A is a partial perspective view of the fixing device depicted in FIG. 4, illustrating the light shield situated at a non-shield position.
Figure 6B:
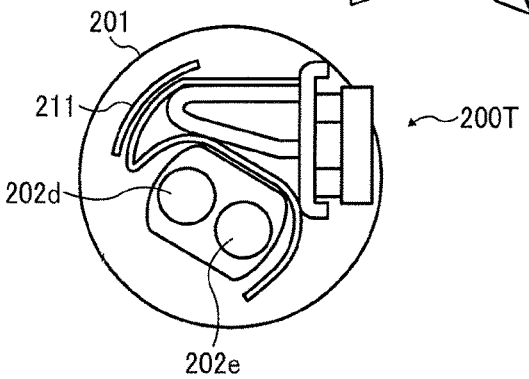
FIG. 6B is a partial vertical cross-sectional view of the fixing device depicted in FIG. 6A.
Figure 6C:
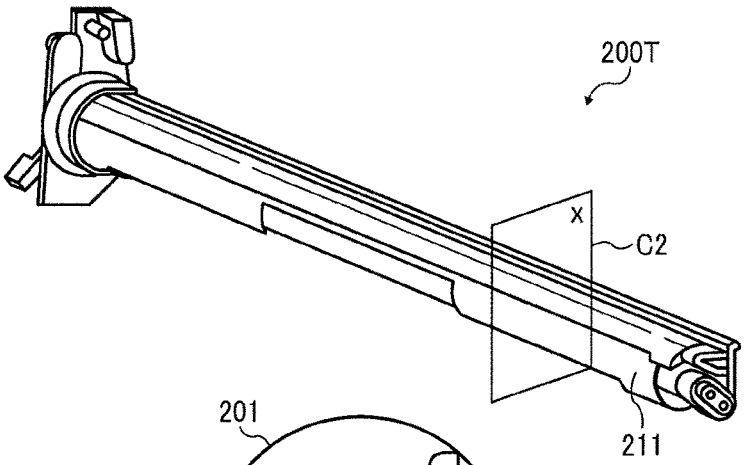
FIG. 6C is a partial perspective view of the fixing device depicted in FIG. 4, illustrating the light shield situated at a shield position.
Figure 6D:
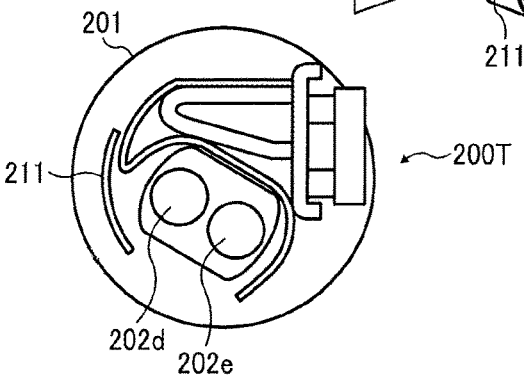
FIG. 6D is a partial vertical cross-sectional view of the fixing device depicted in FIG. 6C.

FIG. 6A is a partial perspective view of the fixing device 200T illustrating the light shield 211 situated at a non-shield position where the light shield 211 does not shield the fixing belt 201 from the halogen heaters 202*d* and 202*e*. FIG. 6B is a partial vertical cross-sectional view of the fixing device 200T taken on a cross-section C1 depicted in FIG. 6A, illustrating the light shield 211 situated at the non-shield position. FIG. 6C is as partial perspective view of the fixing device 200T illustrating the light shield 211 situated at a shield position where the light shield 211 shields the fixing belt 201 from the halogen heaters 202*d* and 202*e*. FIG. 6D is a partial vertical cross-sectional view of the fixing device 200T taken on a cross-section C2 depicted in FIG. 6C, illustrating the light shield 211 situated at the shield position.

As illustrated in FIGS. 6A, 6B, 6C, and 6D, the light shield 211 is pivotable along the inner circumferential surface of the fixing belt 201 without contacting the fixing belt 201. The light shield 211 is selectively pivoted to a plurality of shield positions according to the width of the recording medium S conveyed through the Fixing device 200T, shielding the fixing belt 201 from the halogen heaters 202*d* and 202*e* in an axial span on the fixing belt 201 where heating of the fixing belt 201 is unnecessary. FIGS. 6A and 6B illustrate the light shield 211 situated at the non-shield position corresponding to the A3 size sheet. FIGS. 6C and 6D illustrate the light shield 211 situated at the shield position corresponding to the postcard. Even if a plurality of small recording media S having a width smaller than the width of the A3 size sheet is conveyed through the fixing device 200T continuously, the light shield 211 shields the fixing belt 201 from the halogen heaters 202*d* and 202*e*, preventing overheating of each lateral end of the fixing belt 201 in the axial direction, that is, a non-conveyance span where the small recording media S are not conveyed and removing a control to eliminate an overheated span on the fixing belt 201 in the axial direction thereof, which may degrade productivity of the fixing device 200T. Hence, the fixing device 200T incorporates the two halogen heaters 202*d* and 202*e* decreased compared to the three halogen heaters 202*a*, 202*b*, and 202*c* of the fixing device 200S depicted in FIG. 3.

A detailed description is now given of a construction of the nip formation pad 206.

Figure 7:
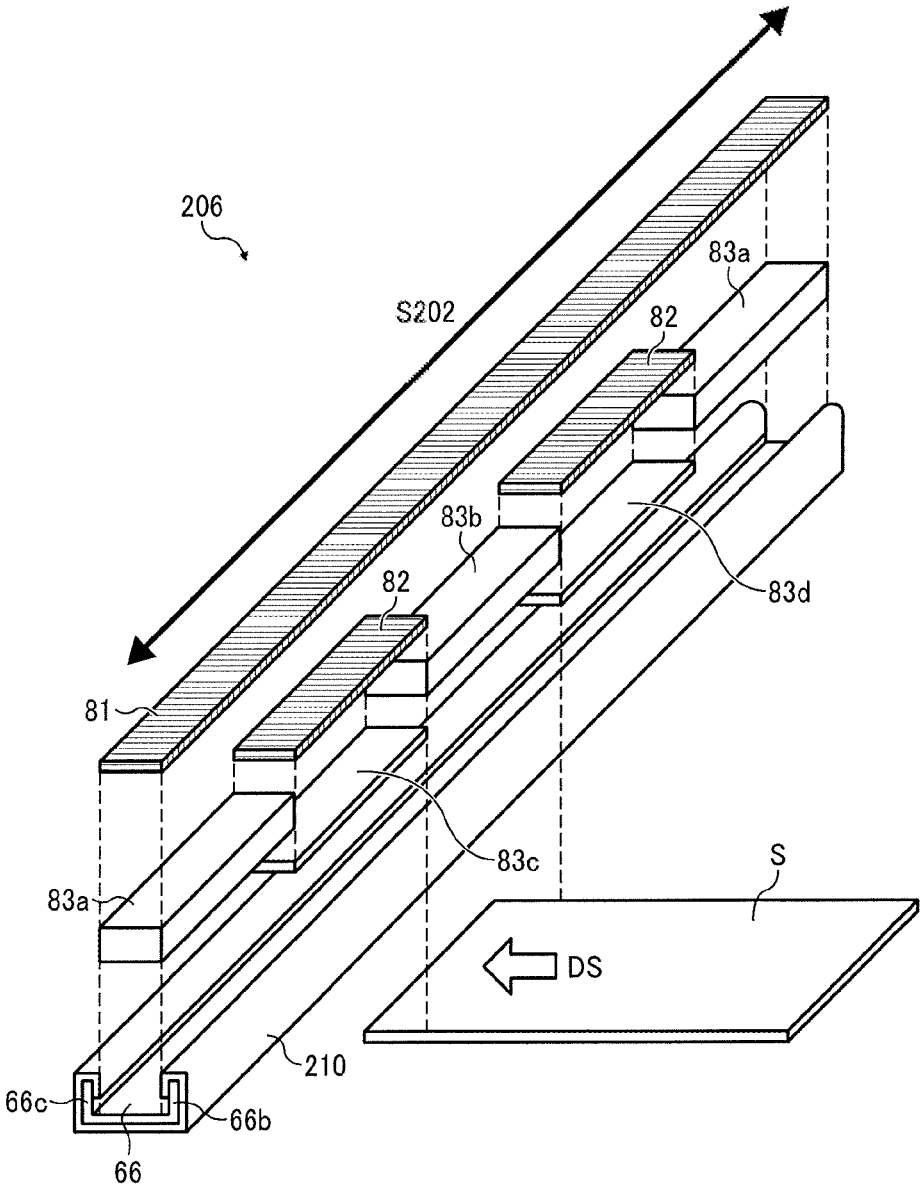
FIG. 7 is an exploded perspective view of a nip formation pad incorporated in the fixing device depicted in FIG. 2.

FIG. 7 is an exploded perspective view of the nip formation pad 206. FIG. 7 illustrates a light irradiation span S202 where light emitted by the heater (e.g., the halogen heaters 202, 202*a*, 202*b*, 202*c*, 202*d*, and 202*e*) irradiates the fixing belt 201. FIG. 7 further illustrates a recording medium S as an A6 size sheet. The nip formation pad 206 reduces overheating of the non-conveyance span of the fixing belt 201 on behalf of the light Shield 211. Accordingly, the nip formation pad 206 allows the fixing devices 200, 200S, and 200T to eliminate the light shield 211 and a driver that drives the light shield 211 and to reduce the number of the halogen heaters 202*a*, 202*b*, 202*c*, 202*d*, and 202*e*, thus reducing manufacturing costs substantially.

As illustrated in FIG. 7, the nip formation pad 206 includes a thermal conductor 66 that conducts heat and mounts the low-friction sheet 210 depicted in FIGS. 2 to 4. As the fixing belt 201 rotates in the rotation direction D201 as illustrated in FIGS. 2 to 4, the fixing belt 201 slides over the low-friction sheet 210 made of a low-friction material that reduces a frictional load imposed to the fixing belt 201 and decreases a driving torque developed between the fixing belt 201 and the nip formation pad 206. The thermal conductor 66 is made of a material having an increased thermal conductivity, for example, copper. The thermal conductor 66 extends in a longitudinal direction thereof parallel to the axial direction of the fixing belt 201. The thermal conductor 66 absorbs excessive heat stored in the non conveyance span on the fixing belt 21 and conducts the absorbed heat in the longitudinal direction of the thermal conductor 66. Accordingly, the thermal conductor 66 equalizes heat in the axial direction of the fixing belt 201.

The thermal conductor 66 includes arms 66*b* and 66*c* (e.g., bent portions). The arm 66*b* disposed upstream from the arm 66*c* in the recording medium conveyance direction DS has a sharp edge. While the fixing belt 201 rotates, the fixing belt 201 pulls the low-friction sheet 210 in the rotation direction D201. However, the sharp edge of the arm 66*b* catches or engages the low-friction sheet 210, securing the low-friction sheet 210 to the nip formation pad 206 solidly. If the fixing belt 201 is configured to rotate in a reverse direction opposite the rotation direction D201, the arm 66*c* has a sharp edge.

The nip formation pad 206 further includes primary thermal insulators 83*a* and 83*b*, secondary thermal insulators 83*c* and 83*d*, a primary thermal absorber 81, and secondary thermal absorbers 82. The primary thermal insulators 83*a* are disposed at both lateral end spans of the nip formation pad 206 in the longitudinal direction thereof. The primary thermal insulator 83*b* is disposed at a center span of the nip formation pad 206 in the longitudinal direction thereof. The primary thermal insulators 83*a* and 83*b* are made of a material having a thermal conductivity smaller than a thermal conductivity of the thermal conductor 66, for example, resin, thus preventing the primary thermal absorber 81 from absorbing heat from the fixing belt 201 excessively. Accordingly, the fixing belt 201 is immune from temperature decrease in a conveyance span of the fixing belt 201 where the recording medium S is conveyed over the fixing belt 201, suppressing faulty fixing, shortening a warm-up time taken to warm up the fixing belt 201, and reducing energy consumption. The warm-up time defines a time taken to warm up a fixing device (e.g., the fixing devices 200, 200S, and 200T) from an ambient temperature to a predetermined temperature (e.g., a reload temperature) at which printing is available after the image forming apparatus 100 is powered on.

Similarly, the secondary thermal insulator 83*c* is made of resin, for example. The secondary thermal insulator 83*c* adjusts an amount of heat conducted from the thermal conductor 66 to the primary thermal absorber 81 through the secondary thermal absorber 82. The thickness and the width of the secondary thermal insulator 83*c* are adjusted based on the degree of overheating or temperature increase of the non-conveyance span of the fixing belt 201.

Each of the primary thermal absorber 81 and the secondary thermal absorbers 82 is made of a material having an increased thermal conductivity. Each of the secondary thermal absorbers 82 is disposed opposite the non-conveyance span of the fixing belt 201 that is susceptible to overheating or temperature increase. Like the secondary thermal insulator 83*c*, the thickness and the width of each of the secondary thermal absorbers 82 are adjusted based on the degree of overheating or temperature increase of the non-conveyance span of the fixing belt 201.

Figure 8A:
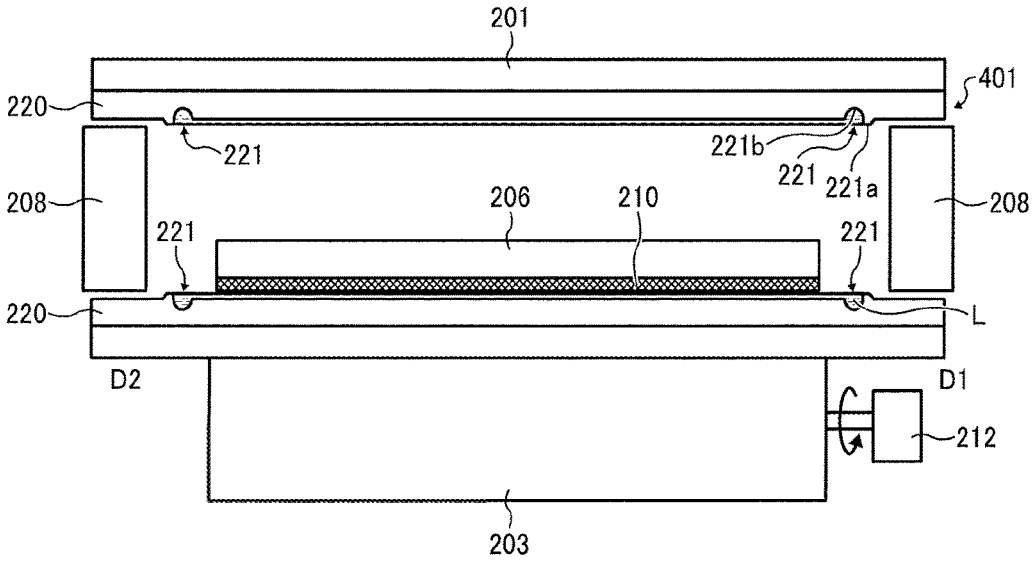
FIG. 8A is a plan view of a lubricant retainer as a first example incorporated in the fixing device depicted in FIG. 2.
Figure 8B:
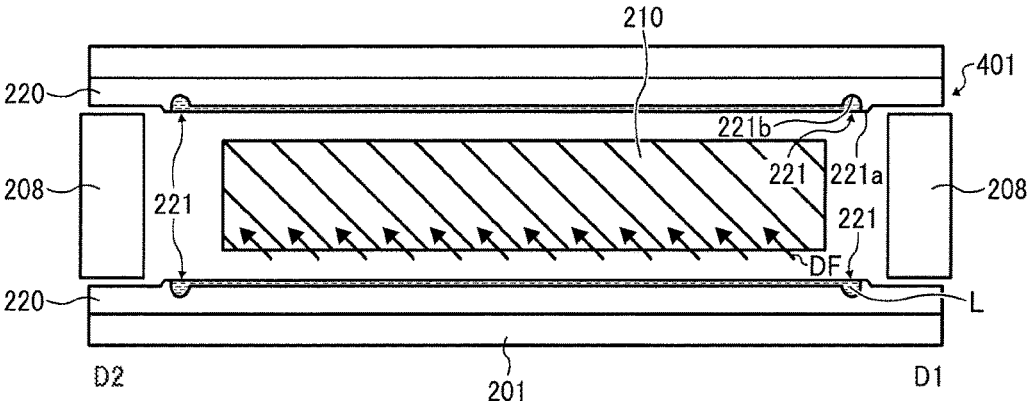
FIG. 8B is a front cross-sectional view of the lubricant retainer depicted in FIG. 8A.

Referring to FIGS. 8A and 8B, a description is provided of a construction of a lubricant retainer 401 as a first example disposed opposite the inner circumferential surface of the fixing belt 201.

FIG. 8A is a plan view of the lubricant retainer 401. FIG. 8B is a front cross-sectional view of the lubricant retainer 401. FIGS. 8A and 8B illustrate a cross-section of an interior of the loop formed by the fixing bell 201.

As described above, as a driving force generated by the driver (e.g., the motor) is transmitted to the pressure roller 203 through a driving gear 212, the pressure roller 203 rotates in the rotation direction D203. Since a spring, or the like presses the pressure roller 203 against the nip formation pad 206 via the fixing belt 201, the fixing belt 201 rotates in accordance with rotation of the pressure roller 203. The driving gear 212 is coupled to one end of the pressure roller 203 in an axial direction thereof to reduce manufacturing costs. The nip formation pad 206 is disposed inside the loop formed by the fixing belt 201 and presses against the pressure roller 203 via the fixing belt 201 to form the fixing nip N between the fixing belt 201 and the pressure roller 203.

The low-friction sheet 210 is interposed between the nip formation pad 206 and the inner circumferential surface of the fixing belt 201.

A description is provided of a construction of a comparative fixing device.

The comparative faxing device includes a low-friction sheet impregnated with a liquid lubricant to lubricate the low-friction sheet. The low-friction sheet impregnated with the lubricant is attached to an opposed face of a nip formation pad that is disposed opposite a fixing rotator (e.g., a fixing belt or fixing film) so that the low-friction sheet decreases a resistance between the nip formation pad and the fixing rotator that slides over the nip formation pad.

The lubricant applied or contained in the low-friction sheet moves in a particular direction varying depending on a weaving direction of the low-friction sheet, deviation in pressure in an axial direction of the fixing rotator at a fixing nip formed between the fixing rotator and a pressure rotator, or the like. When the lubricant dries up, the fixing rotator may slide over the low-friction sheet with an increased friction. Accordingly, the fixing rotator may rotate at varied linear velocities which may cause faulty conveyance of a recording medium. For example, the fixing rotator may crease the recording medium. As the fixing rotator rotates at varied linear velocities that vary in the axial direction of the fixing rotator, the fixing rotator may skew in the axial direction thereof at an increased linear velocity. Accordingly, a lateral edge face of the fixing rotator may suffer from an increased load, shortening the life of the fixing rotator.

The low-friction sheet is made of a low-friction material to enhance the durability of the fixing rotator and is applied with the lubricant. In order to decrease the resistance between the low-friction sheet and the fixing rotator that slides over the low-friction sheet, the lubricant is made of a material having a decreased coefficient of viscosity. However, the lubricant may have an increased flowability and ma flow out of the fixing rotator. The lubricant has a tendency to move in the particular direction varying depending on the weaving direction of the low-friction sheet, deviation in pressure in the axial direction of the fixing rotator at the fixing nip formed between the fixing rotator and the pressure rotator, or the like. Once the lubricant flown out of the fixing rotator produces a flow channel, the lubricant flows out of the fixing rotator continuously until the lubricant on the low-friction sheet dries up.

When the lubricant applied to or impregnated in the low-friction sheet dries up, the fixing rotator may slide over the low-friction sheet with an increased friction. Accordingly, the fixing rotator may rotate at varied linear velocities which may cause faulty conveyance of a recording medium. For example, the fixing rotator may crease the recording medium. As the fixing rotator rotates at varied linear velocities that vary in the axial direction of the fixing rotator, the fixing rotator may skew in the axial direction thereof at an increased linear velocity. Accordingly, the lateral edge face of the fixing rotator may suffer from an increased load, shortening the life of the fixing rotator.

As illustrated in FIG. 8A, since the driving gear 212 is coupled to one end of the pressure roller 203 in the axial direction thereof, the fixing belt 201 is exerted with a driving force in addition to the load imposed at the fixing nip N. Accordingly, pressure exerted at the fixing nip N may vary in the axial direction of the fixing belt 201. Consequently, as illustrated in FIG. 8B, a lubricant L may flow from a driving side D1 of the low-friction sheet 210 disposed opposite one lateral end of the fixing belt 201 in the axial direction thereof to a non-driving side D2 of the low-friction sheet 210 disposed opposite another lateral end of the fixing belt 201 in the axial direction thereof. The driving side D1 of the low-friction sheet 210 presses against the fixing belt 201 with increased pressure. Conversely, the non-driving side D2 of the low-friction sheet 210 presses against the fixing belt 201 with decreased pressure smaller than the increased pressure.

A mechanism to vary the load exerted at the fixing nip N in advance may be employed by considering the driving force. However, since manufacturing error of parts or the like varies pressure exerted at the fixing nip N, such mechanism may not prevent the lubricant L from flowing out of the thermal absorber 220 mounted on the fixing belt 201.

A weaving direction of the low-friction sheet 210 defines a flow direction DF of the lubricant L. FIG. 8B illustrates the flow direction DF corresponding to the weaving direction of the low-friction sheet 210 that is oblique relative to the axial direction of the fixing belt 201. The lubricant L flows in the flow direction DF from the driving side D1 to the non-driving side D2 on the fixing belt 201. To address this circumstance, the low-friction sheet 210 may attain a weaving direction different from the flow direction DF to cause the lubricant L to flow in a flow direction opposite the flow direction DF defined by variation in pressure exerted at the fixing nip N. However, it is difficult to achieve a balance between the weaving direction of the low-friction sheet 210 and the flow direction DF of the lubricant L defined by variation in pressure exerted at the fixing nip N due to the manufacturing error described above.

To address this circumstance, the fixing devices 200, 200S, and 200T installable in the image forming apparatus 100 include the lubricant retainer 401 that prevents the lubricant L from being dried up and thereby suppresses faulty conveyance of the recording medium S by the fixing belt 201 and degradation in the life of the fixing belt 201 as described below.

As illustrated in FIGS. 8A and 8B, the lubricant retainer 401 includes a thermal absorber 220 coating the inner circumferential surface of the fixing belt 201. The thermal absorber 220 absorbs radiant heat radiated from the halogen heater 202 effectively. Coating of the fixing belt 201 by the thermal absorber 220 varies in the axial direction, that is, a longitudinal direction, of the fixing belt 201 to produce an irregular portion 221. The irregular portion 221 includes a projection 221*a* projecting from the thermal absorber 220 and a depression 221*b* recessed into the thermal absorber 220. Thus, the irregular portion 221 serves as a flow reducer that suppresses flow of the lubricant 1 from the fixing belt 201. The thermal absorber 220 is made of a black material that absorbs radiant light radiated from the halogen heater 202 effectively. For example, the thermal absorber 220 is made of fluoroplastic that reduces friction between the low-friction sheet 210 and the thermal absorber 220.

The irregular portion 221 is mounted on the thermal absorber 220 to block the lubricant L flowing on the thermal absorber 220 mounted on the fixing belt 201, thus suppressing the lubricant L from being dried up and thereby preventing faulty conveyance of the recording medium S by the fixing belt 201 and degradation in the life of the fixing belt 201. An amount of projection and depression, that is, a site of projection and depression (e.g., a height of the projection 221*a* and a depth of the depression 221*b*), of the irregular portion 221 is adjusted according to the flow direction DF and the amount of the lubricant L. According to the first example of the lubricant retainer 401, the lubricant L flows in the flow direction DF toward the non-driving side D2. Accordingly, an amount of projection and depression of the irregular portion 221 disposed in the non-driving side D2 is greater than an amount of projection and depression of the irregular portion 221 disposed at the driving side D1.

The lubricant L moves toward one lateral end of the fixing belt 201 in the axial direction thereof, while the lubricant L produces a flow channel, and reaches the holder 208 and other components situated inside the fixing device 200. Hence, the irregular portion 221 is disposed opposite each lateral end of the fixing belt 201 in the axial direction thereof. If a plurality of irregular portions 221 is aligned in the axial direction of the fixing belt 201, the plurality of irregular portions 221 suppresses flow of the lubricant L more effectively. However, the increased number of the irregular portions 221 increases manufacturing costs. To address this circumstance, according to the first example, the irregular portion 221 is disposed opposite each lateral end of the fixing belt 201 in the axial direction thereof. Since the holder 208 is disposed opposite each lateral end of the fixing belt 201 in the axial direction thereof, the irregular portion 221 is disposed inboard from the holder 208 in the axial direction of the fixing belt 201.

Alternatively, the irregular portion 221 may be disposed opposite one lateral end of the fixing, belt 201 in the axial direction thereof. For example, the irregular portion 221 may be disposed opposite the non-driving side D2 of the fixing belt 201 because the lubricant L flows toward the non-driving side D2. In other words, the irregular portion 221 may be disposed opposite one end of the pressure roller 203 in the axial direction thereof where the driving gear 212 is not provided. Thus, the irregular portion 221 suppresses the lubricant L from flowing out of at least one lateral end of the fixing belt 201 in the axial direction thereof and being dried up from the low-friction sheet 210, preventing faulty conveyance of the recording medium S by the fixing belt 201 and degradation in the life of the fixing belt 201.

The projection 221*a* is disposed outboard from the depression 221*b* in the axial direction of the fixing belt 201. In other words, the depression 221*b* is inboard from the projection 221*a* in the axial direction of the fixing belt 201 and is closer to as center of the fixing belt 201 in the axial direction thereof than the projection 221*a* is. The projection 221*a* is adjacent to or abuts on the depression 221*b*. As illustrated in FIG. 8A, the projection 221*a* blocks the lubricant L that flows. The depression 321*k* abutting on the projection 221*a* holds or stores the lubricant L. Thus, the projection 221*a* and the depression 221*b* suppress the lubricant L from being dried up front the low-friction sheet 210, preventing faulty conveyance of the recording medium S by the fixing belt 201 and degradation in the life of the fixing belt 201. The projection 221*a* and the depression 221*b* abutting on each other prevent the lubricant L from flowing out of the thermal absorber 220 mounted on the fixing belt 201 effectively.

The irregular portion 221 is disposed outboard from a nip formation span in the axial direction of the fixing belt 201 where the fixing belt 201 slides over the nip formation pad 206 via the low-friction sheet 210. In other words, the irregular portion 221 is disposed outboard from the nip formation pad 206 in the axial direction of the fixing belt 201. The irregular portion 221 is disposed inboard from a support span in the axial direction of the fixing belt 201 where the holder 208 contacts or supports the fixing belt 201. In other words, the irregular portion 221 is disposed inboard from the holder 208 in the axial direction of the fixing belt 201 and disposed opposite a non-slide span of the fixing belt 201 where the fixing belt 201 slides over neither the nip formation pad 206 nor the holder 208. If the irregular portion 221 is disposed opposite a slide span of the fixing belt 201 where the fixing belt 201 slides over the nip formation pad 206 or the holder 208, the irregular portion 221 may suffer from abrasion over time and degradation in reduction of the lubricant L that flows out of the thermal absorber 220 mounted on the fixing belt 201. To address this circumstance, the irregular portion 221 is disposed opposite the non-slide span interposed between the low-friction sheet 210 mounted on the nip formation pad 206 and the bolder 208 in the axial direction of the fixing belt 201, thus preventing degradation in performance of the irregular portion 221 due to abrasion and thereby improving the life of the fixing belt 201.

Figure 9A:
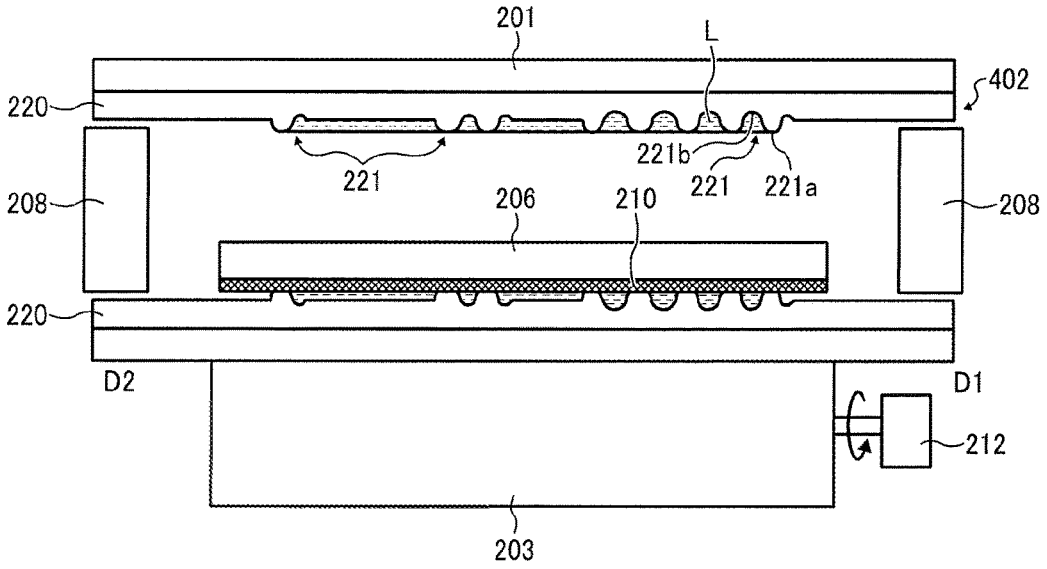
FIG. 9A is a plan view of a lubricant retainer as a second example incorporated in the fixing device depicted in FIG.
Figure 9B:
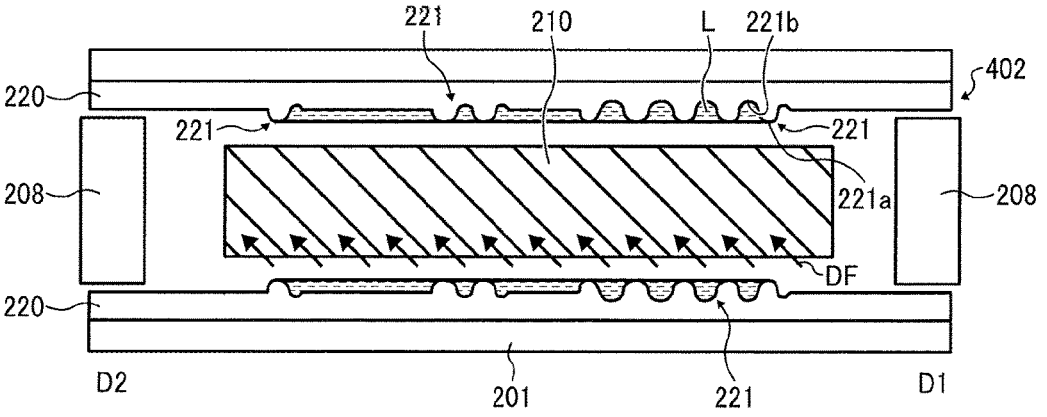
FIG. 9B is a front cross-sectional view of the lubricant retainer depicted in FIG. 9A.

Referring to FIGS. 9A and 9B, a description is provided of a construction of a lubricant retainer 402 as a second example disposed opposite the inner circumferential surface of the fixing belt 201.

FIG. 9A is a plan view of the lubricant retainer 402. FIG. 9B is a front cross-sectional view of the lubricant retainer 402. FIGS. 9A and 9B illustrate a cross-section of the interior of the loop formed by the fixing belt 201.

As illustrated in FIGS. 9A and 9B, the lubricant retainer 402 includes the thermal absorber 220 coating the inner circumferential surface of the fixing belt 201. The thermal absorber 220 absorbs radiant heat radiated from the halogen heater 202 effectively. Coating of the fixing belt 201 by the thermal absorber 220 varies in the axial direction of the fixing belt 201 to produce a plurality of irregular portions 221. The irregular portion 221 includes the projection 221*a* and the depression 221*b*, serving as a flow reducer that suppresses flow of the lubricant L from the thermal absorber 220 mounted on the fixing belt 201. The irregular portion 221 is perpendicular to the flow direction DF of the lubricant L flowing over the inner circumferential surface of the fixing belt 20 via the thermal absorber 220, thus blocking the lubricant L flowing in the flow direction DF. The thermal absorber 220 is made of a black material that absorbs radiant light radiated from the halogen heater 202 effectively. For example, the thermal absorber 220 is made of fluoroplastic that reduces friction between the low-friction sheet 210 and the thermal absorber 220.

The irregular portion 221 is mounted on the thermal absorber 220 such that the irregular portion 221 is perpendicular to the flow direction DF of the lubricant L so as to block the lubricant L being applied to the low-friction sheet 210 and flowing on the thermal absorber 220 mounted on the fixing belt 201, thus suppressing the lubricant L from being dried up and thereby preventing faulty conveyance of the recording medium S by the fixing belt 201 and degradation in the life of the fixing belt 201.

The lubricant L moves toward one lateral end of the fixing belt 201 in the axial direction thereof while the lubricant L produces a flow channel, and reaches the holder 208 and other components situated inside the fixing device 200. To address this circumstance, the plurality of irregular portions 221 is aligned more closely at an upstream position than at a downstream position in the flow direction DF of the lubricant L. In other words, a density of the upstream irregular portions 221 is greater than a density of the downstream irregular portions 221. According to the second example of the lubricant retainer 402, the lubricant L flows in the flow direction DF from the driving side D1 to the non-driving side D2. Accordingly, a density of the irregular portions 221 disposed opposite the driving side D1 is greater than a density of the irregular portions 221 disposed opposite the non-driving side D2. Thus, the irregular portions 221 prevent the lubricant L from being dried up from the low friction sheet 210 effectively, preventing faulty conveyance of the recording medium S by the fixing belt 201 and degradation in the life of the fixing belt 201.

A size of the upstream irregular portion 221 (e.g., the height of the projection 221*a* and the depth of the depression 221*b*) is greater than a size of the downstream irregular portion 221 disposed downstream from the upstream irregular portion 221 in the flow direction DF of the lubricant L. According to the second example of the lubricant retainer 402, the lubricant L flows in the flow direction DF front the driving side D1 to the non driving side D2. Accordingly, the size of the irregular portion 221 disposed opposite the driving side D1 is greater than the size of the irregular portion 221 disposed opposite the non driving side D2. Thus, the irregular portions 221 prevent the lubricant L from being dried up from the low-friction sheet 210 effectively, preventing faulty conveyance of the recording medium S by the fixing belt 201 and degradation in the life of the fixing belt 201.

A width of each of the projection 221*a* and the depression 221*b* of the upstream irregular portion 221 is greater than a width of each of the projection 221*a* and the depression 221*b* of the downstream irregular portion 221 in the axial direction of the fixing belt 201. According to the second example of the lubricant retainer 402, the lubricant L flows in the flow direction DF from the driving side D1 to the non-driving side D2. Accordingly, the width of each of the protection 221*a* and the depression 221*b* of the irregular portion 221 disposed opposite the driving side D1 is greater than the width of each of the projection 221*a* and the depression 221*b* of the irregular portion 221 disposed opposite the non-driving side D2. Thus, the irregular portions 221 prevent the lubricant L from being dried up from the low-friction sheet 210 effectively, preventing faulty conveyance of the recording medium S by the fixing belt 201 and degradation in the life of the fixing belt 201.

A description is provided of advantages of the fixing devices 200, 200S, and 200T.

As illustrated in FIGS. 2 to 4, a fixing device (e.g., the fixing devices 200, 200S, and 200T) includes the fining belt 201 serving as a fixing rotator, the halogen heaters 202, 202*a*, 202*b*, 202*c*, 202*d*, and 202*e* serving as a heater, the nip formation pad 206, the pressure roller 203 serving as a pressure rotator, and the low-friction sheet 210 serving as a low-friction member. As illustrated in FIGS. 8A, 8B, 9A, and 9B, the fixing device further includes the thermal absorber 220 and the irregular portion 221.

As illustrated in FIGS. 2 to 4, the fixing belt 201 is rotatable in a predetermined direction of rotation (e.g., the rotation direction D201). The heater is disposed opposite the fixing belt 201 and heats the fixing belt 201. The nip formation pad 206 is disposed opposite the inner circumferential surface of the fixing belt 201. The pressure roller 203 is pressed against the nip formation pad 206 via the fixing belt 201 to form the fixing nip N between the fixing belt 201 and the pressure roller 203, through which a recording medium S bearing a toner image T is conveyed. The low-friction sheet 210 is sandwiched between the nip formation pad 206 and the fixing belt 201 and carries a lubricant L that flows in the flow direction DF. For example, the low-friction sheet 210 is applied or impregnated with the lubricant L. As illustrated in FIGS. 8A, 8B, 9A, and 9B, the thermal absorber 220 is mounted on the inner circumferential surface of the fixing belt 201. The irregular portion. 221 is mounted on the thermal absorber 220 and prevents the lubricant L from flowing out of the thermal absorber 220 mounted on the fixing belt 201.

As illustrated in FIGS. 8A and 8B, the irregular portion 221 mounted on the thermal absorber 220 blocks the lubricant L leaking from the low-friction sheet 210, thus suppressing the lubricant L from being dried up and thereby preventing faulty conveyance of the recording medium S by the fixing belt 201 and degradation in the life of the fixing belt 201.

Since the lubricant L flows out of at least one lateral end of the fixing belt 201 in the axial direction thereof, the irregular portion 221 is disposed opposite the lateral end of the fixing, belt 201 in the axial direction thereof. Thus, the irregular portion 221 prevents the lubricant L from flowing out of the lateral end of the fixing belt 201 in the axial direction thereof and being dried up from the low-friction sheet 210, thus suppressing faulty conveyance of the recording medium S by the fixing belt 201 and degradation in the life of the fixing belt 201.

Since the lubricant L flows out of the lateral end of the fixing belt 201 in the axial direction thereof, the projection 221*a* of the irregular portion 221 is disposed opposite the lateral end of the fixing belt 201 in the axial direction thereof. The depression 221*b* abutting on the projection 221*a* is disposed inboard from the projection 221*a* in the axial direction of the fixing belt 201 such that the depression 221*b* is closer to the center of the fixing belt 201 in the axial direction thereof than the projection 221*a* is. Thus, the projection 221*a* blocks the lubricant L flowing in the flow direction DF. The depression 221*b* abutting on the projection 221*a* holds or stores the lubricant L. Thus, the projection 221*a* and the depression 221*b* prevent the lubricant L from flowing out of the thermal absorber 220 mounted on the fixing belt 201 and being dried up from the low-friction sheet 210, preventing faulty conveyance of the recording medium S by the fixing belt 201 and degradation in the life of the fixing belt 201.

The irregular portion 221 is disposed outboard from the slide span in the axial direction of the fixing belt 201 where the fixing belt 201 slides over the nip formation pad 206 via the low-friction sheet 210. The irregular portion 221 is disposed inboard from the support span in the axial direction of the fixing belt 201 where the holder 208 contacts or supports the fixing belt 201. Thus, the irregular portion 221 is immune from abrasion and improves the life.

As illustrated in FIGS. 9A and 9B, the plurality of irregular portions 221 holds or retains the lubricant L in an increased amount greater than a decreased amount retained by the single irregular portion, thus suppressing the lubricant L from being dried up and thereby preventing faulty conveyance of the recording medium S by the fixing belt 201 and degradation in the life of the fixing belt 201 effectively. The irregular portion 221 is perpendicular to the flow direction DF of the lubricant L that flows on the thermal absorber 220 mounted on the inner circumferential surface of the fixing belt 201. The irregular portion 221 blocks the lubricant L flowing in the flow direction DF effectively, preventing the lubricant L from being dried up from the low-friction sheet 210 and preventing faulty conveyance of the recording medium S by the fixing belt 201 and degradation in the life of the fixing belt 201.

The plurality of irregular portions 221 is aligned in the axial direction of the fixing belt 201 such that the density of the irregular portions 221 increases from the downstream position to the upstream position in the flow direction DF of the lubricant L that flows on the thermal absorber 220 mounted on the inner circumferential surface of the fixing belt 201. Thus, the irregular portions 221 prevent the lubricant L from flowing out of the thermal absorber 220 mounted on the fixing belt 201 and being dried up from the low-friction sheet 210 effectively, preventing fruity conveyance of the recording medium S by the fixing belt 201 and degradation in the life of the fixing belt 201 effectively.

The size of the upstream irregular portion 221 that is defined by the height of the projection 221*a* and the depth of the depression 221*b* is greater than the size of the downstream irregular portion 221 disposed downstream from the upstream irregular portion 221 in the flow direction DF of the lubricant L flowing on the thermal absorber 220 mounted on the inner circumferential surface of the fixing belt 201. Thus, the irregular portions 221 prevent the lubricant L from flowing out of the thermal absorber 220 mounted on the fixing belt 201 and being dried up from the low-friction sheet 210 effectively, preventing faulty conveyance of the recording medium S by the fixing belt 201 and degradation in the life of the fixing belt 201 effectively.

The width of the upstream irregular portion 221 is greater than the width of the downstream irregular portion 221 disposed downstream from the upstream irregular portion 221 in the flow direction DF of the lubricant L flowing on the thermal absorber 220 mounted on the inner circumferential surface of the fixing belt 201. Thus, the irregular portions 221 prevent the lubricant L from flowing out of the thermal absorber 220 mounted on the fixing belt 201 and being dried up from the low-friction sheet 210 effectively, preventing faulty conveyance of the recording medium S by the fixing belt 201 and degradation in the life of the fixing belt 201 effectively.

The present disclosure is not limited to the details of the exemplary embodiments described above and various modifications and improvements are possible. For example, the thermal absorber 220 coating the inner circumferential surface of the fixing belt 201 may be made of a material other than the material described above. The size, the shape, and the like of the irregular portion 221 may be adjusted according to the flow direction DF of the lubricant L and the amount of the lubricant L. The basic construction of the fixing devices 200, 200S, and 200T may be modified properly.

Further, the construction of the image forming apparatus 100 may be modified arbitrarily. For example, FIG. 1 illustrates the image forming apparatus 100 using toners in four colors. Alternatively, the image forming apparatus 100 may be a full color image forming apparatus using toners in three colors, a multicolor image forming apparatus using toners in two colors, or a monochrome image forming apparatus using toner in a single color.

According to the exemplary embodiments described above, the fixing belt 201 serves as a fixing rotator. Alternatively, a fixing film, a fixing sleeve, or the like may be used as a fixing rotator. Further, the pressure roller 203 serves as a pressure rotator. Alternatively, a pressure belt or the like may be used as a pressure rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a fixing rotator rotatable in a predetermined direction of rotation;

a heater to heat the fixing rotator;

a nip formation pad disposed opposite an inner circumferential surface of the fixing rotator;

a pressure rotator to press against the nip formation pad via the fixing rotator to form a fixing nip between the fixing rotator and the pressure rotator;

a low-friction member being sandwiched between the nip formation pad and the fixing rotator and bearing a lubricant to flow in a flow direction; and a thermal absorber mounted on the inner circumferential surface of the fixing rotator, wherein the thermal absorber includes at least one irregular structure, which is asymmetrically shaped, to block the lubricant flowing in the flow direction, and the thermal absorber includes at least one section that contacts the lubricant and that does not include any of the at least one irregular structure.

2. The fixing device according to claim 1, wherein the low-friction member is applied with the lubricant.

3. The fixing device according to claim 1, wherein the low-friction member is impregnated with the lubricant.

4. The fixing device according to claim 1, wherein the at least one irregular structure is disposed opposite a lateral end of the fixing rotator in an axial direction of the fixing rotator.

5. The fixing device according to claim 1, wherein the at least one irregular structure is perpendicular to the flow direction of the lubricant.

6. The fixing device according to claim 1, wherein each of the at least one irregular structure includes:

a projection, projecting from the thermal absorber, to block the lubricant; and a depression, being recessed into the thermal absorber and abutting on the projection, to retain the lubricant, the depression being disposed inboard from the projection in an axial direction of the fixing rotator.

7. The fixing device according to claim 6, wherein the at least one irregular structure further includes:

a downstream irregular structure; and an upstream irregular structure disposed upstream from the downstream irregular structure in the flow direction of the lubricant.

8. The fixing device according to claim 7, wherein the projection of the downstream irregular structure has a first height and the depression of the downstream irregular structure has a first depth, and wherein the projection of the upstream irregular structure has a second height greater than the first height of the projection of the downstream irregular structure and the depression of the upstream irregular portion has a second depth greater than the first depth of the depression of the downstream irregular structure.

9. The fixing device according to claim 7, wherein the downstream irregular structure has a first width in the axial direction of the fixing rotator, and wherein the upstream irregular structure has a second width in the axial direction of the fixing rotator, the second width being greater than the first width of the downstream irregular structure.

10. The fixing device according to claim 7, wherein the at least one irregular structure further includes:

another downstream irregular structure adjacent to the downstream irregular structure in the flow direction of the lubricant; and another upstream irregular structure adjacent to the upstream irregular structure in the flow direction of the lubricant, and wherein a spacing between the upstream irregular structure and the another upstream irregular structure is less than a spacing between the downstream irregular structure and the another downstream irregular structure.

11. The fixing device according to claim 7, wherein the at least one irregular structure is disposed outboard from the nip formation pad in the axial direction of the fixing rotator.

12. The fixing device according to claim 11, further comprising a holder to support the fixing rotator, wherein the at least one irregular structure is disposed inboard from the holder in the axial direction of the fixing rotator.

13. The fixing device according to claim 12, further comprising a driving gear coupled to a driving side of the pressure rotator disposed at one end of the pressure rotator in an axial direction of the pressure rotator, the driving gear to rotate the pressure rotator which rotates the fixing rotator.

14. The fixing device according to claim 13, wherein the at least one irregular structure is disposed opposite a non-driving side of the pressure rotator disposed at another end of the pressure rotator in the axial direction of the pressure rotator.

15. The fixing device according to claim 14, wherein the upstream irregular structure is disposed opposite the driving side of the pressure rotator and the downstream irregular structure is disposed opposite the non-driving side of the pressure rotator.

16. The fixing device according to claim 15, wherein the projection of the downstream irregular structure has a first height and the depression of the downstream irregular structure has a first depth, and wherein the projection of the upstream irregular structure has a second height smaller than the first height of the projection of the downstream irregular structure and the depression of the upstream irregular structure has a second depth smaller than the first depth of the depression of the downstream irregular structure.

17. The fixing device according to claim 1, wherein the low-friction member includes a low-friction sheet.

18. The fixing device according to claim 1, wherein the fixing rotator includes an endless belt and the pressure rotator includes a pressure roller.

19. An image forming apparatus comprising:

an image bearer to bear a toner image; and a fixing device disposed downstream from the image bearer in a recording medium conveyance direction to fix the toner image on a recording medium, the fixing device including:

a fixing rotator rotatable in a predetermined direction of rotation;

a heater to heat the fixing rotator;

a nip formation pad disposed opposite an inner circumferential surface of the fixing rotator;

a pressure rotator to press against the nip formation pad via the fixing rotator to form a fixing nip between the fixing rotator and the pressure rotator;

a low-friction member being sandwiched between the nip formation pad and the fixing rotator and bearing a lubricant to flow in a flow direction; and a thermal absorber mounted on the inner circumferential surface of the fixing rotator, wherein the thermal absorber includes at least one irregular structure, which is asymmetrically shaped, to block the lubricant flowing in the flow direction, and the thermal absorber includes at least one section that contacts the lubricant and that does not include any of the at least one irregular structure.

* * * * *